US007096778B2

(12) United States Patent
Sebastian et al.

(10) Patent No.: US 7,096,778 B2
(45) Date of Patent: Aug. 29, 2006

(54) CONTINUOUS PRESS WITH ROLLER BAR JOURNALING PINS

(75) Inventors: Lothar Sebastian, Duisburg (DE); Klaus Schürmann, Jüchen (DE); Werner Gawlitta, Tegelen (NL); Klaus Gerhardt, Rheurdt (DE)

(73) Assignee: Siempelkamp Maschinen-Und Anlagenbau GmbH & Co. KG, Krefeld (DE)

( * ) Notice: Subject to any disclaimer, the term of this patent is extended or adjusted under 35 U.S.C. 154(b) by 0 days.

(21) Appl. No.: 10/918,650

(22) Filed: Aug. 13, 2004

(65) Prior Publication Data

US 2005/0039616 A1 Feb. 24, 2005

(30) Foreign Application Priority Data

Aug. 16, 2003 (DE) ..... 103 37 591

(51) Int. Cl.
*B30B 5/06* (2006.01)

(52) U.S. Cl. ..... 100/151; 100/306; 198/851

(58) Field of Classification Search ..... 100/151, 100/152, 153, 154, 306; 156/583.5; 425/371, 425/372; 198/850, 851, 852, 853, 779; 474/228, 474/230, 231, 202, 206

See application file for complete search history.

(56) References Cited

U.S. PATENT DOCUMENTS

| | | | | | |
|---|---|---|---|---|---|
| 3,701,413 | A | * | 10/1972 | Leahy et al. | 198/779 |
| 4,748,907 | A | * | 6/1988 | Schermutzki | 100/153 |
| 5,054,388 | A | * | 10/1991 | Bielfeldt | 100/154 |

FOREIGN PATENT DOCUMENTS

| | | |
|---|---|---|
| DE | 34 32 548 | 3/1986 |
| DE | 37 43 665 | 7/1989 |
| DE | 43 15 122 | 11/1994 |

* cited by examiner

*Primary Examiner*—Derris H. Banks
*Assistant Examiner*—Jimmy Nguyen
(74) *Attorney, Agent, or Firm*—Andrew Wilford

(57) ABSTRACT

The roller bar chains of a continuous press for producing pressed board provided sufficient play for the roller bars relative to the link chains by having the journaling pins for the link chains extending through bushings which articulate the overlapping link plates together, so that the outer diameters of the pins within these bushings are less than the inner diameters of the bushings. The result is that the roller bar chain has only a single guide plane in the press region between the two press plates.

6 Claims, 10 Drawing Sheets

CONTINUOUS PRESS WITH ROLLER BAR JOURNALING PINS

FIELD OF THE INVENTION

Our present invention relates to a continuous press with roller bar journaling pins and, more particularly, to a continuous press of the ContiRoll® type for the pressing of mats or webs of wood materials in the production of pressed board.

BACKGROUND OF THE INVENTION

In the production of pressed board, for example, oriented strandboard (OSB), medium density fiberboard (MDF), chip board, particle board and fiberboard generally, it is a common practice to utilize a continuous press to compact the mass of wood material, usually with a thermally activatable binder.

The press can have an upper part and a lower part, each of which is provided with an endless steel press belt. The material to be pressed is passed between the belts and respective roller bar chains are interposed between the belts and the upper and lower press plates.

The roller bar chains themselves comprise link chains on opposite sides of the roller bars and engage the roller bars at their ends. The link chains can have outer link plates, inner link plates and pins which hinge the link plates together.

With such continuous presses, generally in addition to the link pins, roll pins are often required with guide rolls which ride upon special rails.

The inner link plates may be provided with slots in which pins of the roller bars engage. Centering springs may be provided between those link plates and the roller bars (see German Patent DE 43 15 122 A1).

In another known embodiment, rollers and guide rails are likewise provided (see DE 34 32 548 C2) and a certain play is developed between the link chain and the roller bars.

In German Patent DE 37 43 665, the ends of the roller bars have roller bars journaling pins which engage in the chain and which are axially shift able relative to the roller bar. Here again rails are required laterally of the pressing region. A double cone sleeve arrangement is required for centering. The journaling pins must be composed of spring steel.

OBJECT OF THE INVENTION

It is the principal object of the present invention to provide a continuous press for the purposes described with a simpler and more reliable construction of the roller bar chain and, particularly, a roller bar chain which can have practically any desired radius of travel while nevertheless insuring precise guidance of the roller bars in the pressing region.

Another object of this invention is to improve upon the prior art roller bar chain arrangements and overcome drawbacks thereof.

SUMMARY OF THE INVENTION

These objects are attained, in accordance with the invention, in a continuous press for producing pressed board which comprises:

an upper and a lower press plate;

respective endless steel belts passing between the press plates and entraining a layer of material therebetween capable of being compressed to form pressed board;

respective roller bar chains displaceable around the upper and lower press plates whereby roller bars of the chains are interposed between the belts and the respective press plates, each of the roller bar chains comprising:

a respective roller bar journaling pin engaged in each end of a respective roller bar, and a link chain at opposite ends of the respective roller bars and receiving the pins with play to entrain the roller bars with the chains, each link chain comprising two rows of outer link plates, two rows of inner link plates overlapped with the outer link plates and link connecting bushings articulating overlapping inner and outer link plates together and traversing the overlapping inner and outer link plates, the roller bar journaling pins traversing the bushings and being received with play in the bushings.

With the system of the invention, the roller bar journaling pins are received with play in bushings which form the pivots between the link plates of the chain and extend through the bushings which, in turn, traverse the overlapping link plates of the chain.

With the invention, the roller bar chain can circulate around the upper part or lower part of the press with the link chains in respective planes alongside the press plates and the roller bars within the press, i.e. between the plates lying in a guide plane which is common to the link chain for those roller bars. It is therefore no longer necessary to provide a separate support plane with guide rolls and guide tracks.

According to the invention, therefore, such guide or support rolls can be completely eliminated.

However, it should be understood that while the invention provides for the possibility of eliminating the guide rolls and separate guide tracks, if desired, they can be used.

The roller bar chains of the invention allow especially binding-free travel over practically any radius so that a precise travel is achieved especially in the region between the upper and lower head press plates.

The two roller bar chains likewise can pass around rerouting pinions and a drive pinion without difficulty.

A particularly simple construction is achieved when, in the region of the link connecting bushings, the journaling pins are of smaller diameter than the inner diameter of the bushing. This insures the sufficient play between the pin and the bushing.

It has also been found to be advantageous to provide the pins so that they are of an outer diameter equal to the inner diameter of the bushing or larger in their regions outside the bushing but of a smaller inside the bushing.

This insures the requisite play and provides shoulders limiting mobility in the longitudinal direction of the pins but guarantees the requisite play in this direction as well.

The inner link plates can be spaced apart by spacing sleeves which can surround the bushing and can be so located that between these spacer sleeves, gaps are provided for the teeth of a drive pinion.

According to a feature of the invention, the pins are received in slots of retaining plates for each pair of neighboring pins and located on the side of the link chain turned away from the roller bar or turned toward the roller bar. The retaining plates may carry the holders for respective centering springs which can center the pins relative to the plate. A support plate likewise traversed by the pins can be connected to a retaining plate by a connector to which the spring holder can be affixed or which may form the spring holder and, if desired, the pins can be divided longitudinally into segments traversing the bushings and segments engaging the roller bars.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
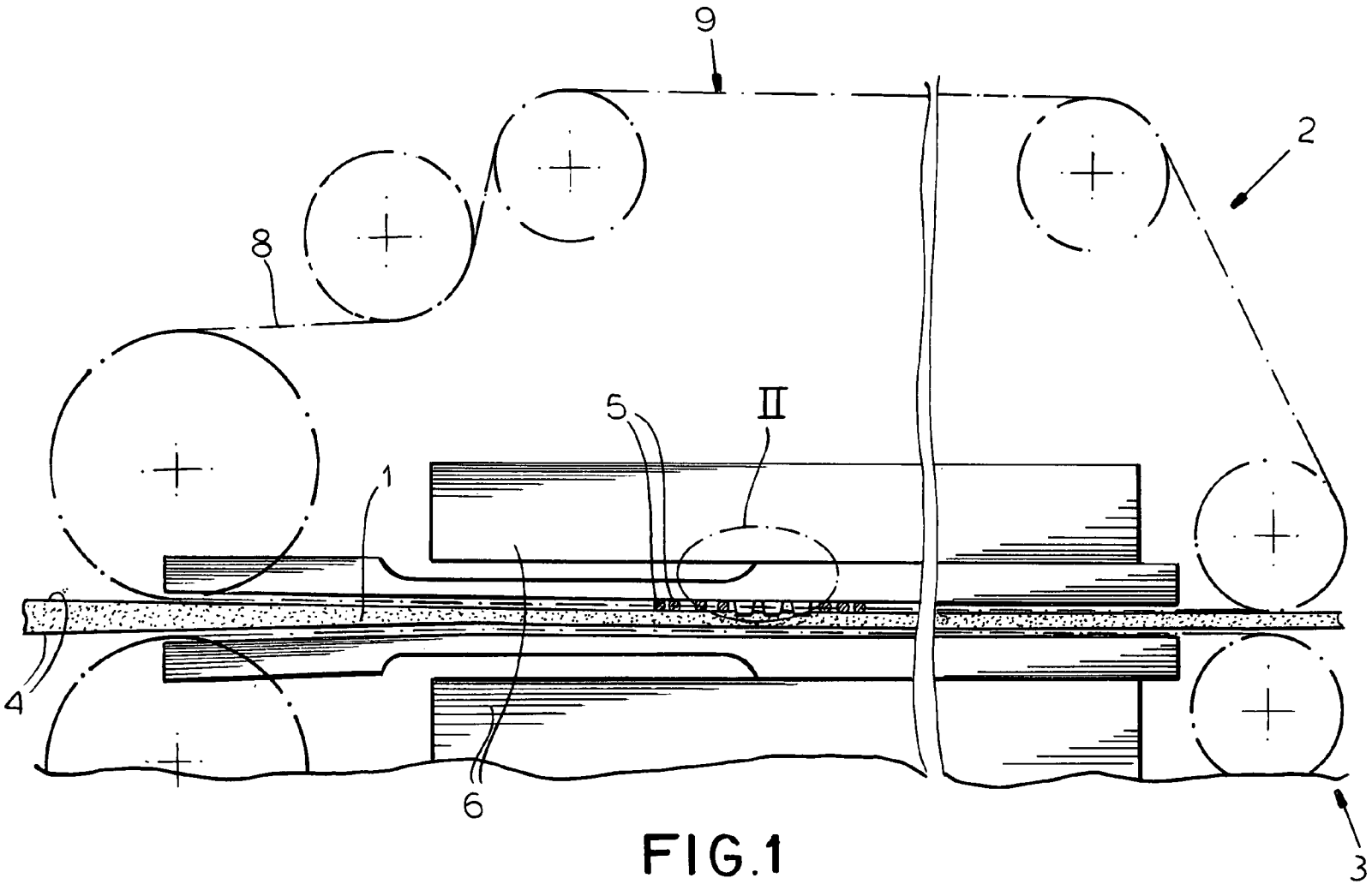
FIG. 1 is a diagrammatic side elevational view, partly broken away, showing a continuous press equipped with roller bar chains in accordance with the invention.

In the drawing we have shown a ContiRoll® type of a continuous press for the pressing of mats or webs of wood material, for example, for the production of oriented strand board (OSB), medium density fiberboard (MDS), particle board, fiberboard generally or any other pressed board of wood material, usually with a binder. All such board will be understood to be encompassed within the term pressed board and the material pressed, in the form of discrete mats or a continuous web, may be referred to here generally as mats.

Figure 2:
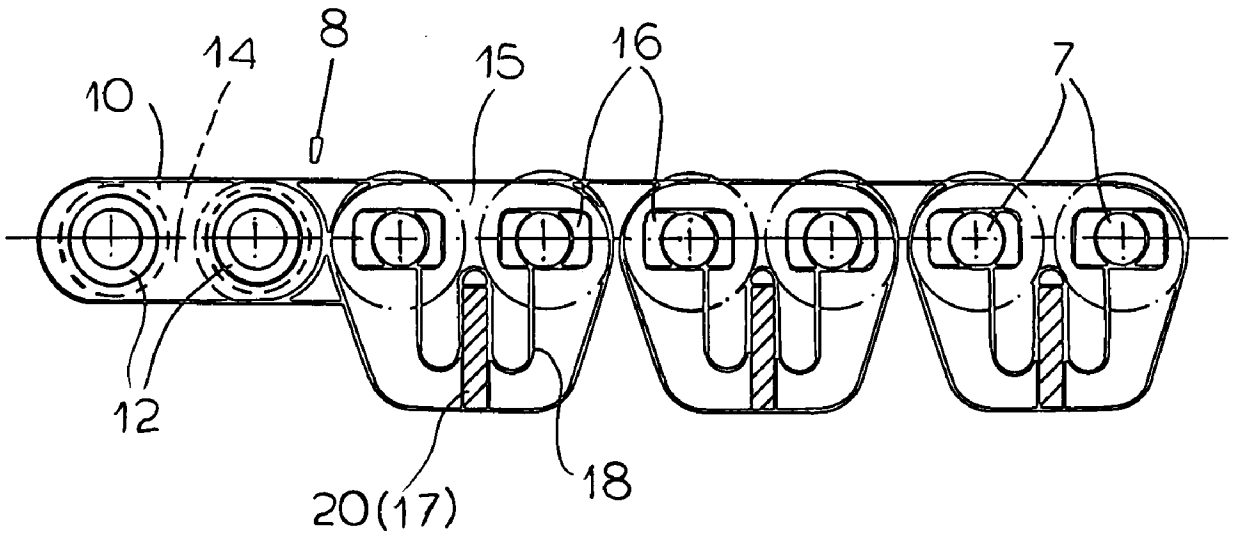
FIG. 2 is a detail of the region II of FIG. 1.
Figure 2A:
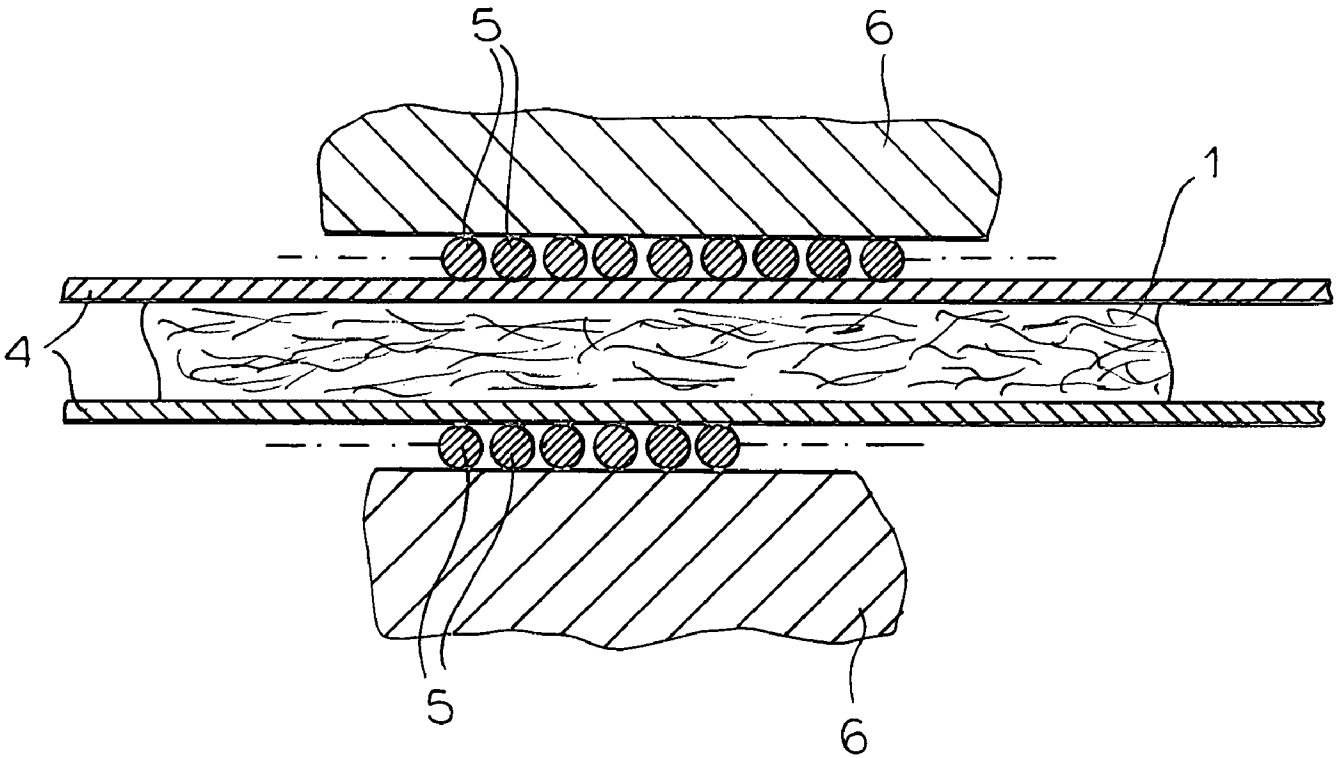
FIG. 2A is a cross sectional view showing he relationship between the roller bars, the steel belts, the press plates and the pressed mats.

This press comprises an upper press part 2 and a lower press part 3 around which respective endless steel press belts 4 may be driven, the belts 4, best seen in FIG. 2A flanking the mat 1. In the pressing region, the belts 4 ride on roller bars 5 which are interposed between the belts 4 and upper and lower heated press plates 6.

The roller bars 5 of the upper and lower press parts 2 and 3 are carried by respective roller bar chains and for this purpose, each roller bar 5 is entrained via respective roller bar journaling pins 7 with play in the link chains 8 at each end of the respective set of roller bars. The circulating path of the upper roller bar chain has been shown at 9 in FIG. 1.

Figure 3:
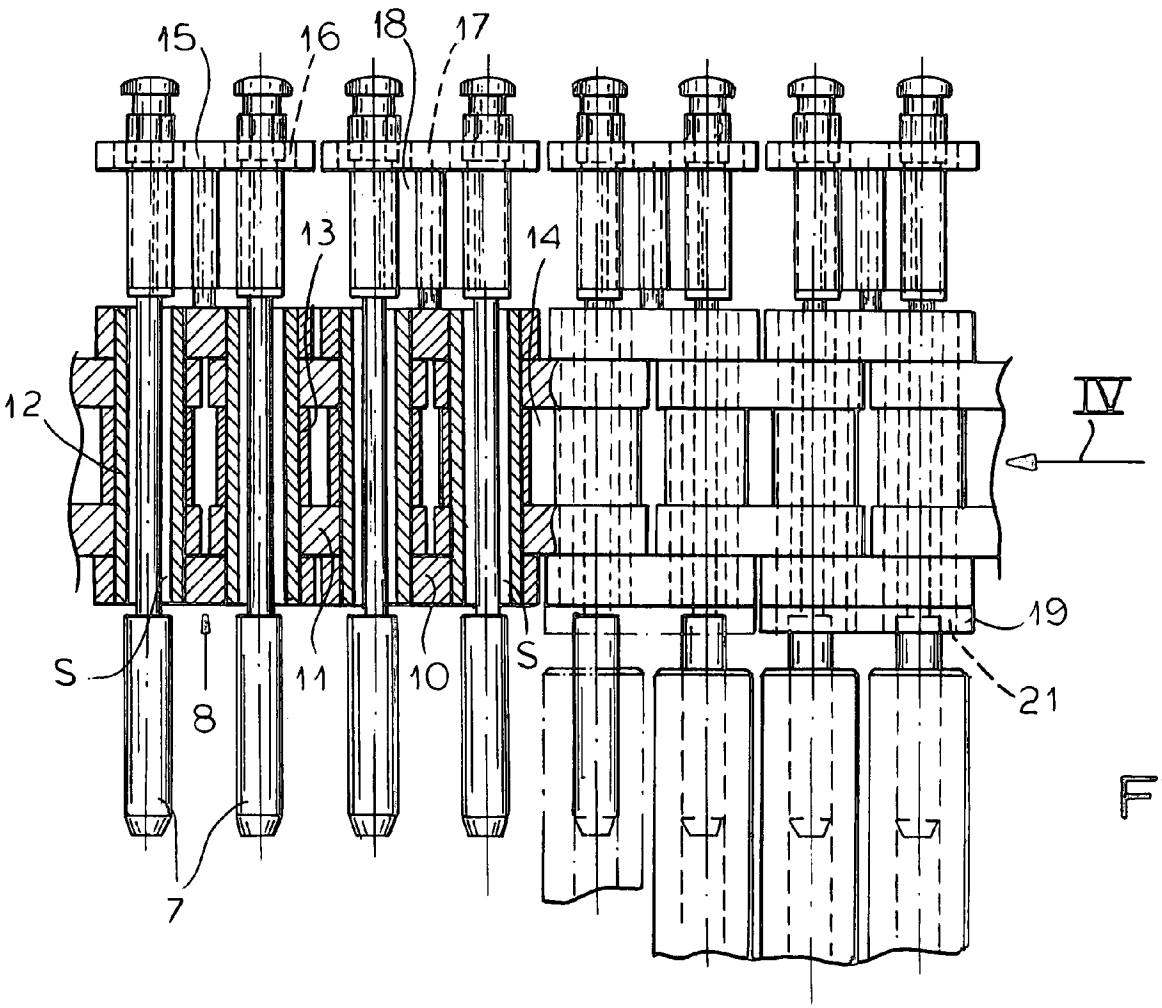
FIG. 3 is a plan view of a portion of the chain as seen in FIG. 2, partly broken away and with the roller bars removed at certain portions.
Figure 3A:
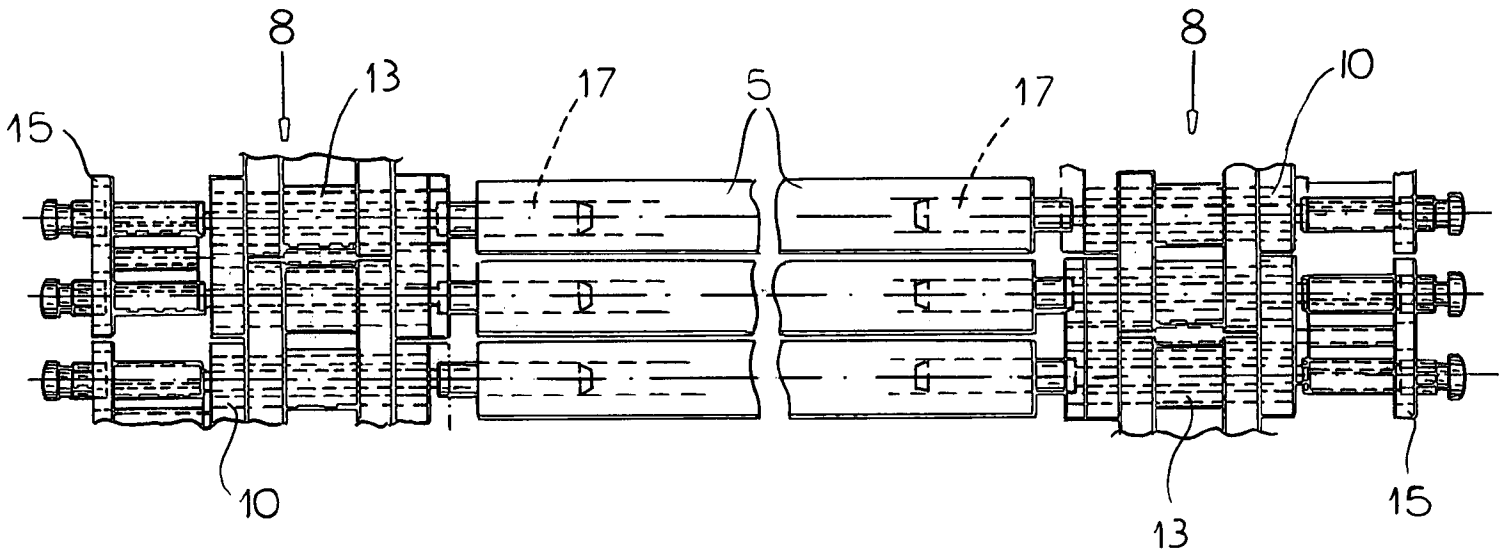
FIG. 3A is a view similar to FIG. 3 indicating that link chains are provided at both ends of the roller bars.

Each of the link chains 8 comprises two rows of outer link plates 10, two rows of inner link plates 11 and link-connecting bushings 12 which articulate overlapping inner and outer link plates together (see especially FIGS. 3 and 3A).

The bushings 12 form bearing sleeves for the roller bar journaling pins 7 and receive the pins 7 with a predetermined play S in the direction of travel of the chain and, optionally, orthogonal thereto and traverse the bearing sleeves or bushings 12 in the longitudinal direction of the roller bars.

At least in the region of the bushing 12 each pin 7 has an outer diameter Da which is less than the inner diameter Di of the bushing 12. Outside of the bushing 12 (see the bottom in section of FIG. 3). The outer diameter of the pin 7 can be the same as the inner diameter Di of the bushings 12. The result is a shoulder on the in which defines a limited longitudinal play Sa transverse to the chain travel direction. The bushing 12 is surrounded over part of the length thereof by a spacing sleeve 13 which maintains a predetermined spacing of the rows of inner link plates 11. Between the sleeves 13, gaps 14 are provided to receive the teeth of a drive sprocket (not shown).

Figure 4:
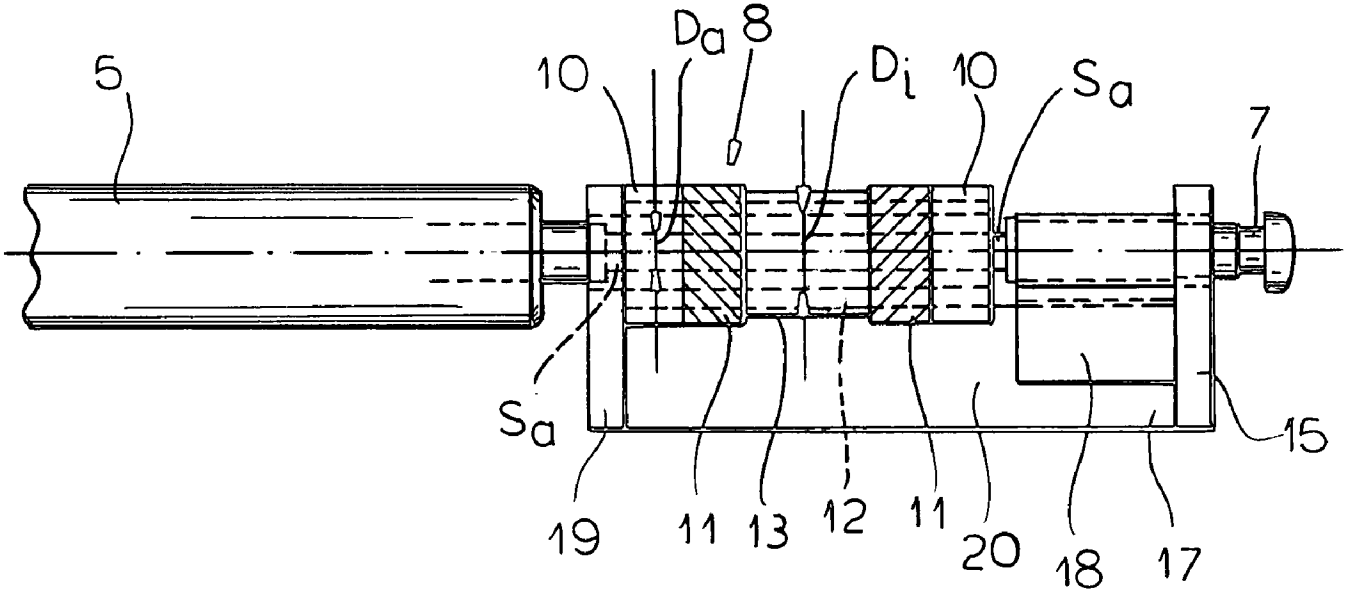
FIG. 4 is a side elevational view taken in the direction of the arrow IV of FIG. 3.

In the embodiment of FIGS. 2–4, each pair of pins 7, on the side of the respective link chain 8 turned away from the roller bars 5, pass through elongated holes 16 in respective pin retaining plates 15, thereby providing play in the chain travel direction. The pin retaining plates 15 have holders 17 for centering springs 18 which act upon the pins 7 and tend to center them with respect to the elongated holes or slots 16.

On the side of the link chain 8 turned toward the roller bars 5, support plates 19 are arranged (FIG. 4) and can be joined to the retaining plates 15 by connectors 20. The support plates 19 can also have elongated holes 21 extending in the chain travel direction to allow for the play S. The connectors 20 form the spring holders for the centering springs 18 at the sides of the retaining plates.

Figure 5:
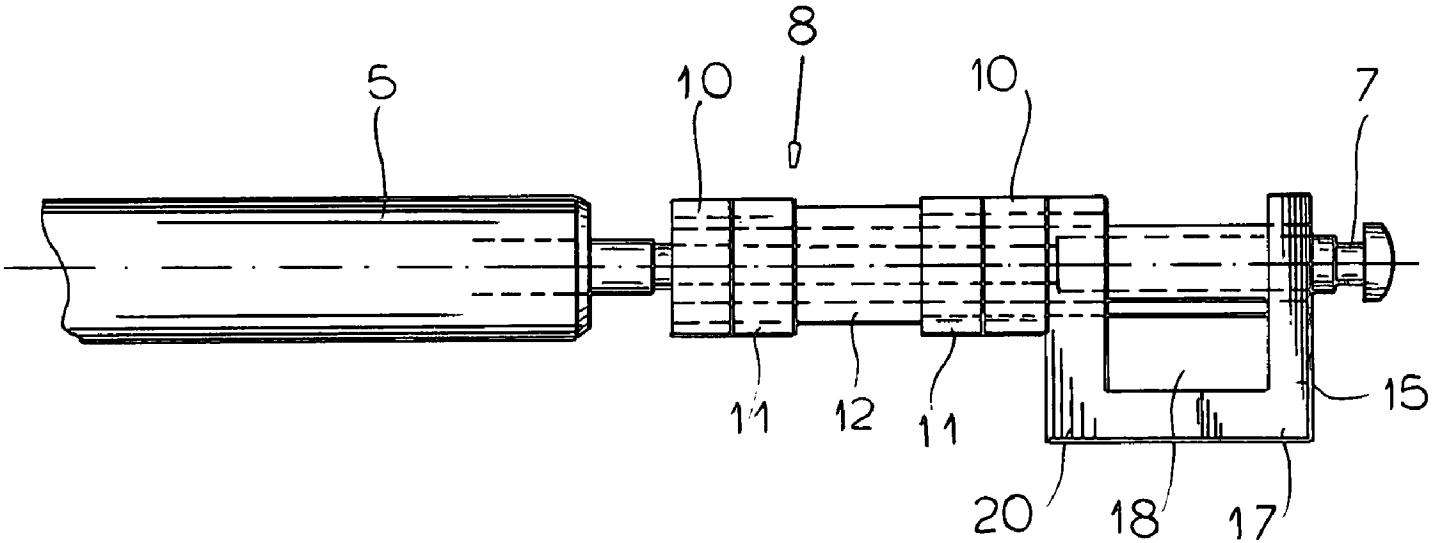
FIG. 5 is a view similar to FIG. 4 of another embodiment.

FIG. 5 shows an embodiment in which the support plates 19 are omitted and the pairs of pins 7 traverse retaining plates 15 which are joined by connectors 20 to the outer link plates 10.

Figure 6:
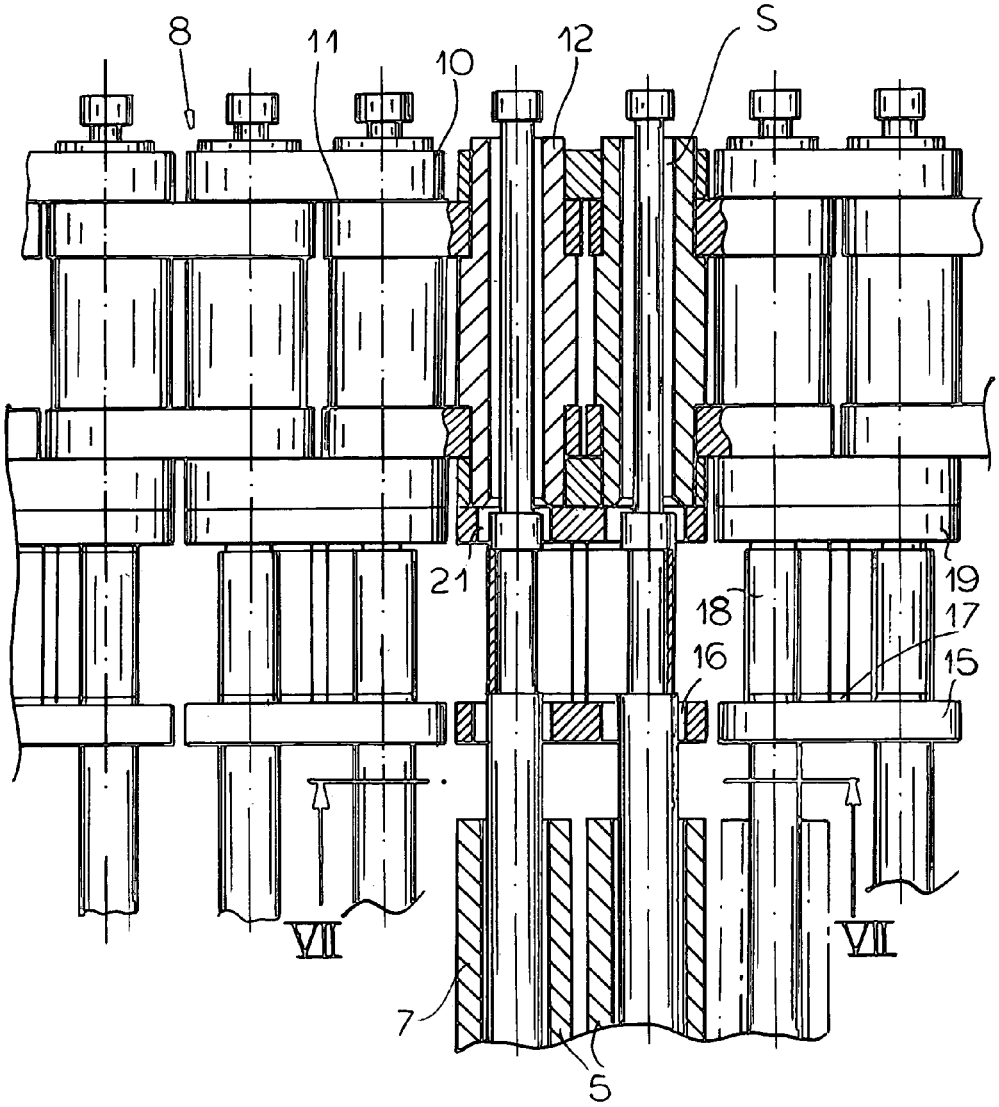
FIG. 6 is a view similar to FIG. 3 of another embodiment of the roller bar chain.
Figure 7:
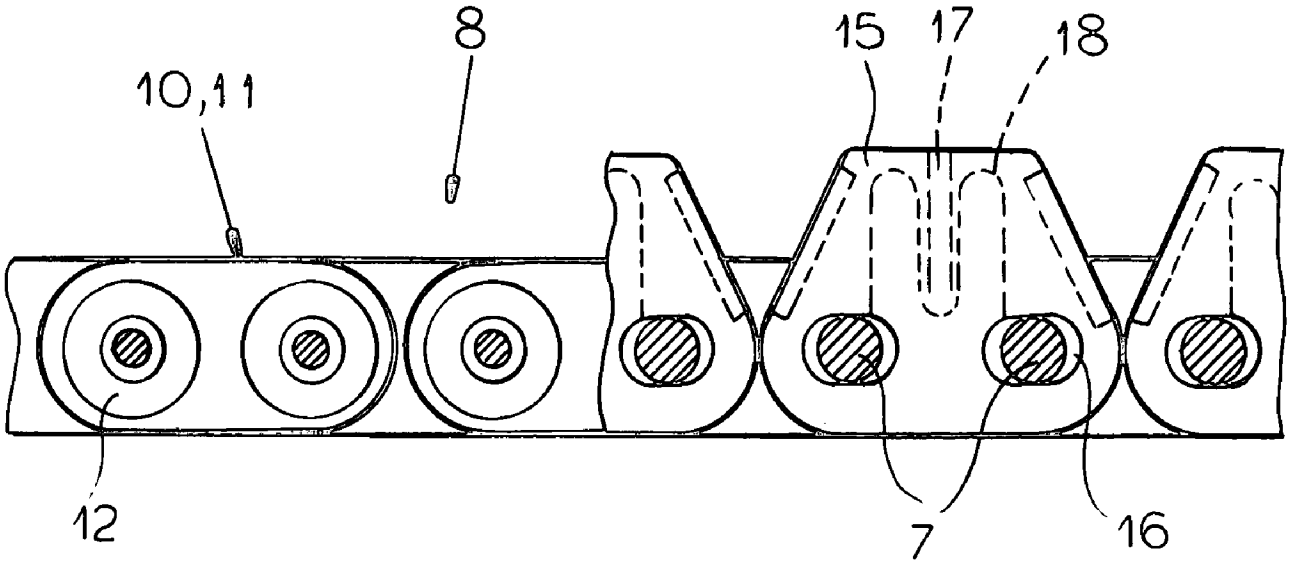
FIG. 7 is a partial vertical section taken along the line VII—VII of FIG. 6.

FIGS. 6 and 7 have two neighboring pins 7 received in slots 16 of retaining plates 15 on the side of the chain 8 turned toward the roller bars 5. The retaining plates 15 carry the holders 17 which connect the retaining plates to support plates 19 and simultaneously act as supports for the centering springs 18. While in the embodiment of FIGS. 2–5, the retaining plates 15 are directed outwardly with respect to the path 9 of the chain, in the embodiment of FIGS. 6 and 7, the plates 15 are directed inwardly.

Figure 8:
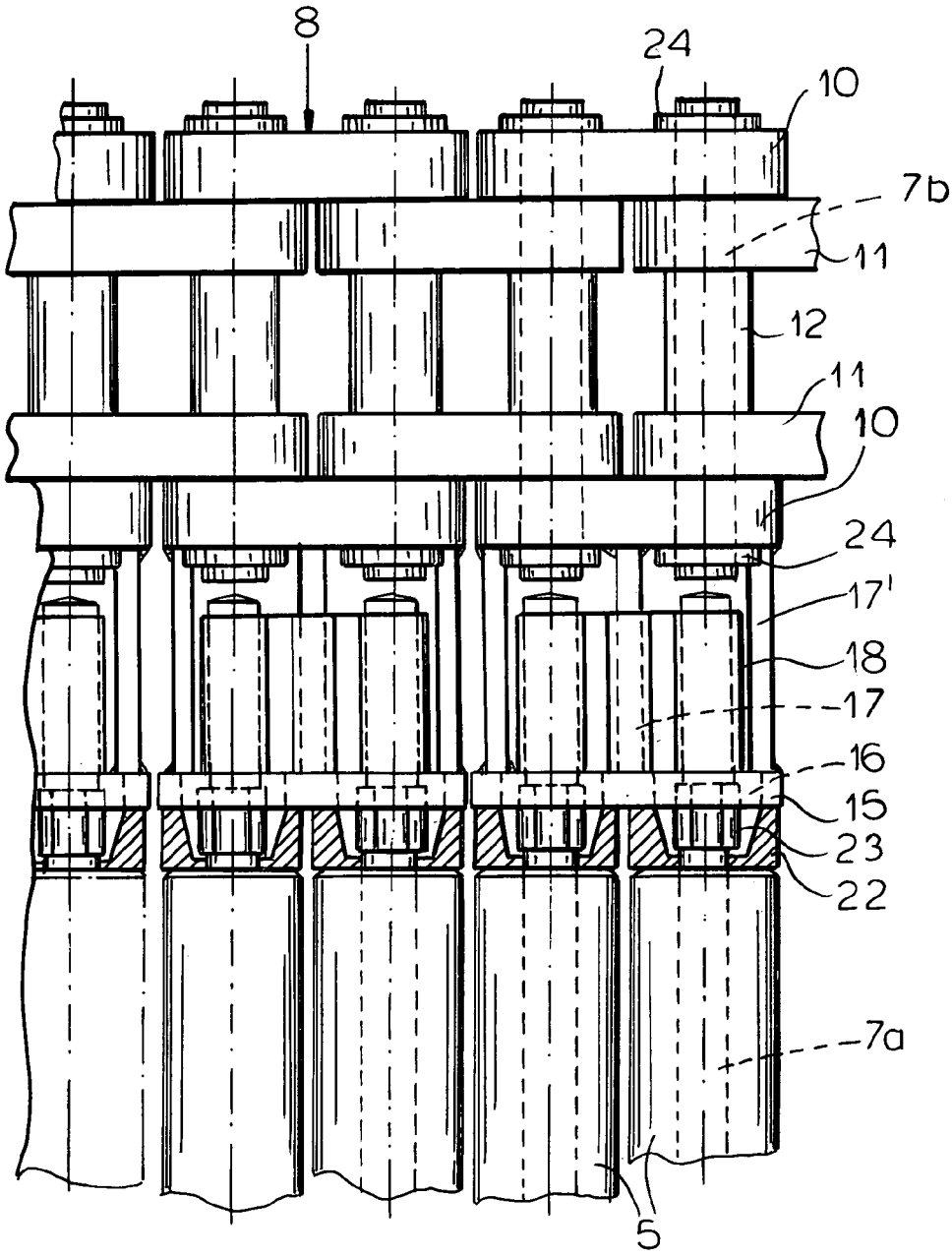
FIG. 8 is a view similar to FIG. 3 illustrating still another embodiment of the chain.

FIG. 8 shows another embodiment in which the pins for journaling the roller bars 5 are divided into pin segments 7*a* and 7*b*. The segments 7*a* engage in the roller bars 5 while the segments 7*b* pass through the bushing 12 traversing the link plates 10 and 11.

In the embodiment of FIG. 8, as in the embodiment of FIG. 7, neighboring pin segments 7*a* are received with play in slots 16 extending in the chain travel direction and formed in retaining plates 15.

These retaining plates are joined to the outer link plate 10 of the chain 8 at its side turned toward the roller bars 8 by connectors 17 and 17'. The connectors 17 form supports for the centering springs 18. Finally sleeves 22 can be seen between the retaining plates 15 and the roller bars 5 and can cooperate with formations 23 which limit relative rotation of the pin segments 7*a* and the sleeves 22.

Locking rings 24 can snap into grooves on the pin segments 7*b* although riveting or screw arrangements may also be used to prevent these segments from slipping out of the bushing 12.

Since the retaining plates 15 form outer chain members, they can be made as fine castings.

Since the forces applied to the chain 8 are not directly carried by the roller bars 5 but rather are taken up by the outer pin segments 7*b* and the bushings 12, the use of the connectors 17 as spring centering spring holders is especially effective.

We claim:

1. A continuous press for producing pressed board comprising:

an upper and a lower press plate;

respective endless steel belts passing between said press plates and entraining a layer of material therebetween capable of being compressed to form pressed board;

respective roller bar chains displaceable around said upper and lower press plates whereby roller bars of said chains are interposed between said belts and the respective press plates, each of said roller bar chains comprising:

a respective roller bar journaling pin engaged in each end of a respective roller bar, and a link chain at opposite ends of the respective roller bars and receiving said pins with play in a direction of travel of the respective chain to entrain said roller bars with said chains, each link chain comprising two rows of outer link plates, two rows of inner link plates overlapped with said outer link plates and link connecting bushings articulating overlapping inner and outer link plates together and traversing the overlapping inner and outer link plates, said roller bar journaling pins traversing said bushings and being received with play in a longitudinal direction of said pins in said bushings at both ends of each bushing;

wherein at least in regions of the link connecting bushings the outer diameters of said roller bar journaling pins are less than the inner diameters of said bushings to provide said play in said direction of travel for said roller bar journaling pins in said bushings, and wherein said pins have diameters at least equal to said inner diameters outside said regions.

2. The continuous press defined in claim 1 wherein said bushings are surrounded by spacer sleeves spacing the rows of inner link plates apart.

3. The continuous press defined in claim 1 wherein on a side of each link chain turned toward or turned away from the respective roller bars, each two neighboring roller bar journaling pins are received in respective elongated holes of a pin-retaining plate affording play in said direction.

4. The continuous press defined in claim 3 wherein said pin-retaining plates are formed with centering spring holders supporting centering springs acting upon the respective pins.

5. A continuous press for producing pressed board comprising:

an upper and a lower press plate;

respective endless steel belts passing between said press plates and entraining a layer of material therebetween capable of being compressed to form pressed board;

respective roller bar chains displaceable around said upper and lower press plates in respective chain-travel directions whereby roller bars of said chains are interposed between said belts and the respective press plates, each of said roller bar chains comprising:

a respective roller bar journaling pin engaged in each end of a respective roller bar, and a link chain at opposite ends of the respective roller bars and receiving said pins with play to entrain said roller bars with said chains, each link chain comprising two rows of outer link plates, two rows of inner link plates overlapped with said outer link plates and link connecting bushings articulating overlapping inner and outer link plates together and traversing the overlapping inner and outer link plates, said roller bar journaling pins traversing said bushings and being received with play in said bushings, wherein on a side of each link chain turned toward or turned away from the respective roller bars, each two neighboring roller bar journaling pins are received in respective elongated holes of a pin-retaining plate affording play in said direction, wherein said pin-retaining plates are formed with centering spring holders supporting centering springs acting upon the respective pin, and wherein said pin-retaining plates are provided in the side of the respective link chain turned away from the respective roller bars, each link chain further comprising support plates on a side of each chain turned toward the respective roller bars and connectors between said support plates and respective pin-retaining plates, said connectors forming the centering spring holders.

6. A continuous press for producing pressed board comprising:

an upper and a lower press plate;

respective endless steel belts passing between said press plates and entraining a layer of material therebetween capable of being compressed to form pressed board;

respective roller bar chains displaceable around said upper and lower press plates in respective chain-travel directions whereby roller bars of said chains are interposed between said belts and the respective press plates, each of said roller bar chains comprising:

a respective roller bar journaling pin engaged in each end of a respective roller bar, and a link chain at opposite ends of the respective roller bars and receiving said pins with play to entrain said roller bars with said chains, each link chain comprising two rows of outer link plates, two rows of inner link plates overlapped with said outer link plates and link connecting bushings articulating overlapping inner and outer link plates together and traversing the overlapping inner and outer link plates, said roller bar journaling pins traversing said bushings and being received with play in said bushings, and wherein said pins are divided into two substantially coaxial pin segments, one of said pin segments engaging the respective roller bar the other pin segment engaging in a respective one of said bushings, and wherein the other pin segments of two neighboring pins are received with play in respective elongated holes of a retaining plate secured by a connector to a respective outer link plate.

* * * * *